US012268272B2

(12) United States Patent
Cheney et al.

(10) Patent No.: US 12,268,272 B2
(45) Date of Patent: Apr. 8, 2025

(54) RAPID-ENTRY FOOTWEAR HAVING A ROTATING REAR PORTION AND A FULCRUM

(71) Applicant: FAST IP, LLC, Lindon, UT (US)

(72) Inventors: Craig Cheney, Lindon, UT (US); Steven Hermann, Eagle Mountain, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 18/125,737

(22) Filed: Mar. 24, 2023

(65) Prior Publication Data

US 2023/0225450 A1 Jul. 20, 2023

Related U.S. Application Data

(63) Continuation of application No. PCT/US2021/054817, filed on Oct. 13, 2021.

(60) Provisional application No. 63/091,290, filed on Oct. 13, 2020.

(51) Int. Cl.

| | |
|---|---|
| ***A43B 11/00*** | (2006.01) |
| ***A43B 3/24*** | (2006.01) |
| ***A43B 21/433*** | (2006.01) |

(52) U.S. Cl.

CPC ..... *A43B 11/00* (2013.01); *A43B 3/248* (2013.01); *A43B 21/433* (2013.01)

(58) Field of Classification Search

CPC ..... A43B 11/00

See application file for complete search history.

(56) References Cited

U.S. PATENT DOCUMENTS

| | | | |
|---|---|---|---|
| 112,439 | A | 3/1871 | Francis |
| 287,312 | A | 10/1883 | Packard |
| 736,156 | A | 8/1903 | Roberts |
| 808,948 | A | 1/1906 | Roberts |
| 827,330 | A | 7/1906 | Tillson |
| 863,549 | A | 8/1907 | Metz |
| 881,153 | A | 3/1908 | Rickert |
| 921,461 | A | 5/1909 | Rickert |
| 923,860 | A | 6/1909 | Kroell |
| 1,081,678 | A | 12/1913 | Meyer |
| 1,116,462 | A | 11/1914 | Moran |
| 1,266,620 | A | 5/1918 | Peabody |
| 1,464,342 | A | 8/1923 | Rothacher |
| 1,494,236 | A | 5/1924 | Greathouse |
| 1,686,175 | A | 10/1928 | Read |

(Continued)

FOREIGN PATENT DOCUMENTS

| | | | |
|---|---|---|---|
| CN | 1403041 | A | 3/2003 |
| CN | 201005111 | Y | 1/2008 |

(Continued)

OTHER PUBLICATIONS https://us.ecco.com/ecco-biom-fjuel-mens-outdoor-shoe-837594.html?dwvar_837594_color=00001 submitted herewith as of Jun. 1, 2016.

(Continued)

*Primary Examiner* — Ted Kavanaugh

(57) ABSTRACT

A rapid-entry shoe having a rotating rear portion configured to be rotated around an axis of rotation and deflected at a fulcrum to create a stress in the rotating rear portion when the shoe is in a collapsed configuration to bias the shoe toward an uncollapsed configuration.

16 Claims, 5 Drawing Sheets

(56) References Cited

U.S. PATENT DOCUMENTS

| | | | |
|---|---|---|---|
| 1,926,818 | A | 9/1933 | Rateliff |
| 2,069,752 | A | 2/1937 | Dorr |
| 2,083,390 | A | 6/1937 | Murena |
| 2,118,019 | A | 5/1938 | Benjafield |
| 2,266,732 | A | 12/1941 | Babinchak |
| 2,297,594 | A | 9/1942 | Weinstat |
| 2,368,514 | A | 1/1945 | Baehr |
| 2,450,250 | A | 9/1948 | Napton |
| 2,452,502 | A | 10/1948 | Tarbox |
| 2,693,039 | A | 11/1954 | Balut |
| 2,736,110 | A | 2/1956 | Hardimon |
| 2,763,071 | A | 9/1956 | Napier |
| 2,829,448 | A | 4/1958 | Minera |
| 2,920,402 | A | 1/1960 | Minera |
| 3,000,116 | A | 9/1961 | Ally |
| 3,014,288 | A | 12/1961 | Evans et al. |
| 3,040,454 | A | 6/1962 | Topper et al. |
| 3,097,438 | A | 7/1963 | Evans |
| 3,146,535 | A | 9/1964 | Owings |
| 3,192,651 | A | 7/1965 | Smith |
| 3,373,512 | A | 3/1968 | Jacobson |
| 3,643,350 | A | 2/1972 | Paoletta et al. |
| 3,798,802 | A | 3/1974 | Saunders |
| 4,489,509 | A | 12/1984 | Libit |
| 4,590,690 | A | 5/1986 | Pfander |
| 4,596,080 | A | 6/1986 | Benoit et al. |
| 4,805,321 | A | 2/1989 | Tonkel |
| 4,811,502 | A | 3/1989 | Barret |
| 4,924,605 | A | 5/1990 | Spademan |
| 4,972,613 | A | 11/1990 | Loveder |
| 4,979,319 | A | 12/1990 | Hayes |
| 5,054,216 | A | 10/1991 | Lin |
| 5,090,140 | A | 2/1992 | Sessa |
| 5,127,170 | A | 7/1992 | Messina |
| 5,174,050 | A | 12/1992 | Gabrielli |
| 5,181,331 | A | 1/1993 | Berger |
| 5,184,410 | A | 2/1993 | Hamilton |
| 5,257,470 | A | 11/1993 | Auger et al. |
| 5,259,126 | A | 11/1993 | Rosen |
| 5,265,353 | A | 11/1993 | Marega et al. |
| 5,282,327 | A | 2/1994 | Ogle |
| 5,311,678 | A | 5/1994 | Spademan |
| 5,341,583 | A | 8/1994 | Hallenbeck |
| 5,351,583 | A | 10/1994 | Szymber et al. |
| 5,353,526 | A | 10/1994 | Foley et al. |
| 5,371,957 | A | 12/1994 | Gaudio |
| 5,430,961 | A | 7/1995 | Faulconer et al. |
| 5,467,537 | A | 11/1995 | Aveni et al. |
| 5,481,814 | A | 1/1996 | Spencer |
| 5,806,208 | A | 9/1998 | French |
| 5,842,292 | A | 12/1998 | Siesel |
| 5,846,063 | A | 12/1998 | Lakic |
| 5,983,530 | A | 11/1999 | Chou |
| 5,997,027 | A | 12/1999 | Jungkind |
| 6,000,148 | A | 12/1999 | Cretinon |
| 6,014,823 | A | 1/2000 | Lakic |
| 6,125,555 | A | 10/2000 | Schenkel |
| 6,128,837 | A | 10/2000 | Huang |
| 6,170,173 | B1 | 1/2001 | Caston |
| 6,189,239 | B1 | 2/2001 | Gasparovic et al. |
| 6,290,559 | B1 | 9/2001 | Scott |
| 6,321,466 | B1 | 11/2001 | Bordin et al. |
| 6,360,454 | B1 | 3/2002 | Dachgruber et al. |
| 6,367,171 | B1 | 4/2002 | Burt |
| 6,378,230 | B1 | 4/2002 | Rotem et al. |
| 6,427,361 | B1 | 8/2002 | Chou |
| 6,470,537 | B1 | 10/2002 | Schallenkamp |
| 6,643,954 | B2 | 11/2003 | Voswinkel |
| 6,671,980 | B1 | 1/2004 | Liu |
| 6,684,533 | B1 | 2/2004 | Su |
| 6,839,985 | B2 | 1/2005 | Bettiol |
| 6,877,252 | B2 | 4/2005 | Wilkinson |
| 6,922,917 | B2 | 8/2005 | Kerns et al. |
| 6,925,732 | B1 | 8/2005 | Clarke |
| 6,938,361 | B2 | 9/2005 | Su |
| 7,059,068 | B2 | 6/2006 | Magallanes et al. |
| 7,103,994 | B2 | 9/2006 | Johnson |
| 7,178,270 | B2 | 2/2007 | Hurd et al. |
| 7,225,563 | B2 | 6/2007 | Chen et al. |
| 7,439,837 | B2 | 10/2008 | McDonald |
| D583,956 | S | 12/2008 | Chang et al. |
| 7,661,205 | B2 | 2/2010 | Johnson |
| 7,685,747 | B1 | 3/2010 | Gasparovic et al. |
| 7,757,414 | B2 | 7/2010 | Tonkel |
| 7,793,438 | B1 | 9/2010 | Busse et al. |
| 7,823,299 | B1 | 11/2010 | Brigham |
| D648,512 | S | 11/2011 | Schlageter et al. |
| 8,065,819 | B2 | 11/2011 | Kaufman |
| 8,161,669 | B2 | 4/2012 | Keating |
| 8,225,535 | B2 | 7/2012 | Dillenbeck |
| 8,302,329 | B2 | 11/2012 | Hurd et al. |
| 8,333,021 | B2 | 12/2012 | Johnson |
| 8,745,901 | B2 | 6/2014 | Toraya |
| 8,769,845 | B2 | 7/2014 | Lin |
| 9,119,441 | B2 | 9/2015 | Frappier |
| 9,314,067 | B2 | 4/2016 | Bock |
| 9,351,532 | B2 | 5/2016 | Mokos |
| 9,615,624 | B2 | 4/2017 | Kilgore et al. |
| 9,629,416 | B2 | 4/2017 | Rackiewicz et al. |
| 9,635,905 | B2 | 5/2017 | Dekovic |
| 9,675,132 | B2 | 6/2017 | Marshall |
| 9,717,304 | B2 | 8/2017 | Bernhard et al. |
| 9,820,527 | B2 | 11/2017 | Pratt et al. |
| 9,999,278 | B2 | 6/2018 | Feinstein |
| 10,327,515 | B2 | 6/2019 | Peyton et al. |
| D854,303 | S | 7/2019 | Flanagan et al. |
| 10,455,898 | B1 | 10/2019 | Orand et al. |
| 10,499,707 | B2 | 12/2019 | Hobson et al. |
| 10,506,842 | B2 | 12/2019 | Pratt et al. |
| 10,537,154 | B2 | 1/2020 | Smith et al. |
| 10,568,382 | B2 | 2/2020 | Hatfield et al. |
| 10,609,981 | B1 | 4/2020 | Phinney |
| 10,617,174 | B1 | 4/2020 | Hopkins et al. |
| 10,638,810 | B1 | 5/2020 | Cheney et al. |
| 10,653,209 | B2 | 5/2020 | Pratt et al. |
| 10,660,401 | B1 | 5/2020 | Pratt et al. |
| 10,765,167 | B2 | 9/2020 | Azoulay et al. |
| 10,791,796 | B1 | 10/2020 | Baker |
| 10,813,405 | B2 | 10/2020 | Pratt |
| 10,905,192 | B1 | 2/2021 | Cheney |
| 10,912,348 | B2 | 2/2021 | Owings et al. |
| 10,973,278 | B2 | 4/2021 | Raia |
| 11,000,091 | B1 | 5/2021 | Kyle |
| 11,140,941 | B2 | 10/2021 | Xanthos et al. |
| 11,154,113 | B2 | 10/2021 | Hatfield et al. |
| 11,172,727 | B2 | 11/2021 | Hatfield et al. |
| 11,191,320 | B2 | 12/2021 | Happen |
| 11,213,098 | B2 | 1/2022 | Beers et al. |
| 11,234,482 | B2 | 2/2022 | Roser |
| D948,190 | S | 4/2022 | Jury |
| D948,191 | S | 4/2022 | Holmes |
| D949,540 | S | 4/2022 | Jury |
| D949,544 | S | 4/2022 | Witherow |
| D955,732 | S | 6/2022 | Kelley |
| 11,633,005 | B2 | 4/2023 | Pratt et al. |
| 11,633,006 | B2 | 4/2023 | Pratt et al. |
| 11,633,016 | B2 | 4/2023 | Orand et al. |
| 11,659,886 | B2 | 5/2023 | Cheney et al. |
| 11,700,916 | B2 | 7/2023 | Kilgore et al. |
| 11,707,113 | B2 | 7/2023 | Hopkins et al. |
| D993,601 | S | 8/2023 | Wang et al. |
| 11,737,511 | B2 | 8/2023 | Cheney et al. |
| 11,744,319 | B2 | 9/2023 | Farina |
| 2001/0001350 | A1 | 5/2001 | Aguerre |
| 2002/0053147 | A1 | 5/2002 | Borsoi et al. |
| 2002/0066213 | A1 | 6/2002 | Wells |
| 2002/0095823 | A1 | 7/2002 | Laio et al. |
| 2002/0144434 | A1 | 10/2002 | Farys et al. |
| 2002/0174568 | A1 | 11/2002 | Neiley |
| 2003/0106244 | A1 | 6/2003 | Miller et al. |
| 2004/0003517 | A1 | 1/2004 | Marvin et al. |
| 2004/0088890 | A1 | 5/2004 | Matis et al. |
| 2004/0111921 | A1 | 6/2004 | Lenormand |
| 2005/0022428 | A1 | 2/2005 | Anderson |

(56) References Cited

U.S. PATENT DOCUMENTS

2005/0034328 A1 2/2005 Geer
2005/0039348 A1 2/2005 Raluy et al.
2005/0066543 A1 3/2005 Rosen et al.
2005/0198867 A1 9/2005 Labbe
2005/0241189 A1 11/2005 Elkington et al.
2007/0074425 A1 4/2007 Leong
2007/0180730 A1 8/2007 Greene et al.
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0086911 A1 4/2008 Labbe
2008/0189984 A1 8/2008 Januszewski et al.
2008/0276492 A1 11/2008 Burnett
2008/0307673 A1 12/2008 Johnson
2008/0313929 A1 12/2008 Hoyt
2009/0090026 A1 4/2009 Mosher
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0016751 A1 1/2011 Somerville
2011/0146106 A1 6/2011 Kaufman
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0216429 A1 8/2012 Bastida et al.
2012/0317839 A1 12/2012 Pratt
2013/0160328 A1 6/2013 Hatfield et al.
2013/0185959 A1 7/2013 Coleman
2013/0219747 A1 8/2013 Lederer
2013/0312285 A1 11/2013 Sharma et al.
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 7/2014 Adami et al.
2014/0259781 A1 9/2014 Sakai
2014/0298687 A1 10/2014 Flinterman et al.
2014/0305005 A1 10/2014 Yeh
2014/0373396 A1 12/2014 Chang
2015/0013184 A1 1/2015 Beers
2015/0013189 A1 1/2015 Hanak et al.
2015/0020416 A1 1/2015 Wiens
2015/0047222 A1 2/2015 Rushbrook
2015/0047223 A1 2/2015 Flinterman et al.
2015/0165338 A1 6/2015 Choe
2015/0216252 A1 8/2015 Wiens
2015/0305432 A1 10/2015 Wiens
2015/0305442 A1 10/2015 Ravindran
2016/0007674 A1 1/2016 Labonte et al.
2016/0128424 A1 5/2016 Connell et al.
2016/0262492 A1 9/2016 Fujita et al.
2016/0302530 A1 10/2016 Smith et al.
2016/0374427 A1 12/2016 Zahabian
2017/0013915 A1 1/2017 Caston, Jr.
2017/0035148 A1 2/2017 Marvin et al.
2017/0127755 A1 5/2017 Bunnell et al.
2017/0215525 A1 8/2017 Labbe
2017/0265562 A1 9/2017 Mullen
2017/0360143 A1 12/2017 Pratt et al.
2017/0360151 A1 12/2017 Pratt
2018/0110287 A1 4/2018 Hopkins et al.
2018/0110292 A1 4/2018 Beers et al.
2018/0199659 A1 7/2018 Lintaman
2018/0235314 A1 8/2018 Farage
2018/0255865 A1 9/2018 Hsu
2018/0263332 A1 9/2018 Bruno
2018/0289109 A1 10/2018 Beers et al.
2018/0295942 A1 10/2018 Drake
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 10/2019 Nakaya et al.
2019/0307208 A1 10/2019 Corcoran-Tadd et al.
2019/0365029 A1 12/2019 Cross et al.
2019/0366667 A1 12/2019 Cross et al.
2020/0015544 A1 1/2020 Pratt
2020/0037703 A1 2/2020 Twist
2020/0046066 A1 2/2020 DiFrancisco
2020/0068991 A1 3/2020 Steere et al.
2020/0085136 A1 3/2020 Pratt et al.
2020/0113274 A1 4/2020 Butler
2020/0187590 A1 6/2020 Hopkins et al.
2020/0196703 A1 6/2020 Hopkins
2020/0196787 A1 6/2020 Dament et al.
2020/0205511 A1 7/2020 Hopkins et al.
2020/0205512 A1 7/2020 Blanche et al.
2020/0205516 A1 7/2020 Kilgore
2020/0205518 A1 7/2020 Hopkins et al.
2020/0205520 A1* 7/2020 Kilgore ..... A43B 11/00
2020/0245797 A1 8/2020 Kim
2020/0253333 A1 8/2020 Kilgore et al.
2020/0305552 A1 10/2020 Cheney et al.
2020/0323308 A1 10/2020 Dubuisson
2020/0375319 A1 12/2020 Yang
2020/0383424 A1 12/2020 Hughes
2021/0059351 A1 3/2021 Piacentini
2021/0068493 A1 3/2021 Pratt et al.
2021/0068494 A1 3/2021 Zahabian
2021/0068498 A1 3/2021 Cheney et al.
2021/0106094 A1 4/2021 Cheney
2021/0112911 A1 4/2021 Pratt et al.
2021/0112914 A1 4/2021 Cheney
2021/0112916 A1 4/2021 Schulten
2021/0127788 A1 5/2021 Li
2021/0145114 A1 5/2021 Kyle
2021/0169177 A1 6/2021 Yang
2021/0186146 A1 6/2021 Erwin
2021/0204642 A1 7/2021 Kyle
2021/0204643 A1 7/2021 Kyle
2021/0204644 A1 7/2021 Kyle
2021/0204645 A1 7/2021 Pratt
2021/0227923 A1 7/2021 Love et al.
2021/0235811 A1 8/2021 Oh
2021/0282495 A1 9/2021 Davis et al.
2021/0321718 A1 10/2021 Chang
2021/0330033 A1 10/2021 Pratt et al.
2021/0337922 A1 11/2021 Cheney
2021/0345727 A1 11/2021 Raia
2022/0104582 A1 4/2022 Christensen et al.
2022/0132976 A1 5/2022 Bentz
2022/0142291 A1 5/2022 Cheney et al.
2022/0240625 A1 8/2022 Shin
2022/0287406 A1 9/2022 Cheney et al.
2022/0287407 A1 9/2022 Cheney et al.
2022/0361627 A1 11/2022 Cheney et al.
2022/0369758 A1 11/2022 Pratt
2022/0378144 A1 12/2022 Pratt et al.
2022/0400810 A1 12/2022 Cheney et al.
2023/0030016 A1 2/2023 Pratt et al.
2023/0033366 A1 2/2023 Farina
2023/0035573 A1 2/2023 Bar
2023/0052916 A1 2/2023 Bar
2023/0055164 A1 2/2023 Cheney et al.
2023/0077572 A1 3/2023 Dean et al.
2023/0081272 A1 3/2023 Pratt
2023/0084256 A1 3/2023 Brilliant
2023/0218033 A1 7/2023 Cheney
2023/0263270 A1 8/2023 Jones
2023/0276897 A1 9/2023 Cheney et al.

(56) References Cited

U.S. PATENT DOCUMENTS

| | | | | |
|---|---|---|---|---|
| 2023/0284737 | A1 | 9/2023 | Bar | |
| 2023/0363489 | A1* | 11/2023 | Kyle | A43B 3/248 |

FOREIGN PATENT DOCUMENTS

| | | | |
|---|---|---|---|
| CN | 101991227 | A | 3/2011 |
| CN | 107467775 | A | 12/2017 |
| CN | 108577022 | A | 9/2018 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| EP | 1059044 | A1 | 12/2000 |
| EP | 1952715 | A1 | 8/2008 |
| EP | 3266327 | A1 | 1/2018 |
| FR | 3066679 | A1 | 11/2018 |
| GB | 2517399 | A | 2/2015 |
| JP | 01-081910 | U | 6/1989 |
| JP | 11-127907 | A | 5/1999 |
| JP | 2001-149394 | A | 6/2001 |
| JP | 2010-104416 | A | 5/2010 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 10-0936510 | B1 | 1/2010 |
| NL | 2000762 | C1 | 1/2009 |
| WO | 2007/080205 | A1 | 7/2007 |
| WO | 2009/089572 | A1 | 7/2009 |
| WO | 2009/154350 | A1 | 12/2009 |
| WO | 2017/004135 | A2 | 1/2017 |
| WO | 2018/230961 | A1 | 12/2018 |
| WO | 2019/215359 | A1 | 11/2019 |
| WO | 2020/006490 | A1 | 1/2020 |
| WO | 2020/176653 | A1 | 9/2020 |
| WO | 2021/162569 | A1 | 8/2021 |
| WO | 2022/204444 | A1 | 9/2022 |
| WO | 2022/221339 | A1 | 10/2022 |
| WO | 2023/049414 | A1 | 3/2023 |
| WO | 2023/064568 | A1 | 4/2023 |

OTHER PUBLICATIONS https://www.teva.com/kids-sandals/hurricane-drift/ 1102483C.html submitted herewith as of Jun. 13, 2019.

International Preliminary Report on Patentability received for PCT Patent Application No. PCT/US21/054817 mailed on Apr. 27, 2023, 6 pages.

International Search Report and Written Opinion received for PCT Patent Application No. PCT/US21/54817, mailed on Jan. 27, 2022, 6 pages.

Sneider, "Kizik Handsfree New York Shoe Review," https://the-gadgeteer.com/2018/06/27/kizik-handsfree-new-york-show-review/ (2018).

U.S. Provisional Application filed Jun. 29, 2015 by Zahabian., U.S. Appl. No. 62/186,148.

* cited by examiner

RAPID-ENTRY FOOTWEAR HAVING A ROTATING REAR PORTION AND A FULCRUM

CROSS-REFERENCE TO RELATED APPLICATIONS

This application is a continuation of, claims priority to and the benefit of PCT Serial No. PCT/US21/54817 filed Oct. 13, 2021 and entitled "RAPID-ENTRY FOOTWEAR HAVING A ROTATING REAR PORTION AND A FULCRUM." PCT Serial No. PCT/US21/54817 claims the benefit of U.S. Provisional Patent Application No. 63/091,290, filed Oct. 13, 2020 and entitled "RAPID-ENTRY FOOTWEAR HAVING A ROTATING REAR PORTION AND A FULCRUM." All of the aforementioned applications are incorporated herein by reference in their entireties.

FIELD

The present disclosure relates to footwear, and more particularly to rapid-entry footwear having a rotating rear portion and a fulcrum.

BACKGROUND

Whether due to inconvenience or inability, donning and doffing of shoes, including tying or otherwise securing the same, may be undesirable and/or present difficulties to some individuals. The present disclosure addresses this need.

SUMMARY

A rapid-entry shoe in accordance with example embodiments of the present disclosure comprises a sole portion, an upper, a rotating rear portion coupled to the upper at an axis of rotation, a fulcrum, and a rear stabilizer coupled to the rotating rear portion. In example embodiments, the rear stabilizer is configured to prevent inward deflection of the rotating rear portion.

In example embodiments, the rapid-entry shoe has an uncollapsed configuration and further has a collapsed configuration to facilitate donning and doffing of the rapid-entry shoe. In example embodiments, in the collapsed configuration, the rotating rear portion is rotated around the axis of rotation toward the sole portion and deflected at the fulcrum to create a stress in the rotating rear portion. In example embodiments, the rapid-entry shoe is biased by the stress toward the uncollapsed configuration.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
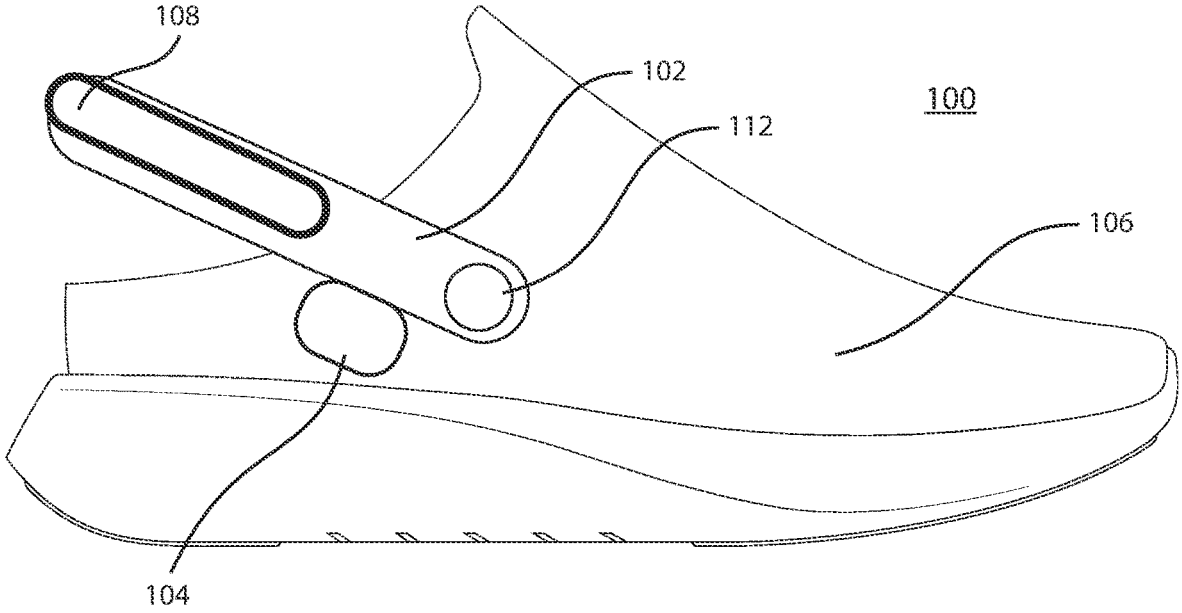
FIGS. 1A and 1B illustrate an example embodiment of a rapid-entry shoe having a fulcrum coupled to an upper, in uncollapsed and collapsed configurations, respectively.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic.

Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, unless the context dictates otherwise, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe, for example, an insole or an internal cushion.

With reference to the drawings, a rapid-entry shoe 100 in accordance with the present disclosure comprises a sole portion, an upper 106 coupled to the sole portion, a rotating rear portion 102 coupled to the upper 106 (e.g., at an axis of rotation), and a fulcrum 104.

In example embodiments, the rotating rear portion 102 extends between opposing sides of the rapid-entry shoe 100 (e.g., rotating rear portion 102 is v-shaped, u-shaped or horse-shoe-shaped (with consistent or inconsistent curvature as it rounds a rear portion of an upper)). In other embodiments, the rotating rear portion 102 is on a single side of the rapid-entry shoe 100 (e.g., rotating rear portion 102 is j-shaped, I-shaped).

In example embodiments, the rotating rear portion 102 is a strap, such that there is a window defined between the rotating rear portion 102 and a rear portion of the upper 106. In other embodiments, the rotating rear portion 102 is a heel cup.

In example embodiments, the rotating rear portion 102 has a perimeter greater than a perimeter of a rear portion of the upper 106 such that the rotating rear portion 102 could be rotated downward past the rear portion of the upper 106 (but for the intervention of fulcrum 104). In example embodiments, the rotating rear portion 102 has a perimeter greater than a perimeter of a rear portion of the sole portion such that the rotating rear portion 102 could be rotated downward past the rear portion of the sole portion (but for the intervention of fulcrum 104).

In example embodiments, a rapid-entry shoe 100 in accordance with the present disclosure comprises a coupling 112 between the rotating rear portion 102 and the upper 106. The coupling 112 can be fixed (e.g., and permit only resilient deformation of the rotating rear portion 102 relative to the upper 106) or the coupling 112 can permit rotational relative movement (e.g., 360 degrees, or at least until movement of the rotating rear portion 102 is prevented by the upper 106 or the sole portion) between the rotating rear portion 102 and the upper 106. In this regard, a single coupling 112 (or a pair of opposing couplings 112) can define an axis of rotation between a rotating rear portion 102 and an upper 106.

In example embodiments, the fulcrum 104 is a protrusion, extension or other structure configured to act as a pivot, deflector or stopper. In this regard, in some example embodiments, the fulcrum 104 has a hardness greater than a hardness of the rotating rear portion 102, and in other example embodiments, a topline edge of upper 106 has a hardness greater than a hardness of the fulcrum 104. In example embodiments, the fulcrum 104 is spaced apart from the coupling 112.

While the rapid-entry shoe 100 may be described herein in connection with a single fulcrum, it will be apparent to those skilled in the art that a plurality of fulcrums 104 are also contemplated (e.g., two fulcrums 104, on opposing sides of the rapid-entry shoe 100, but otherwise structurally the same).

Figure 1B:
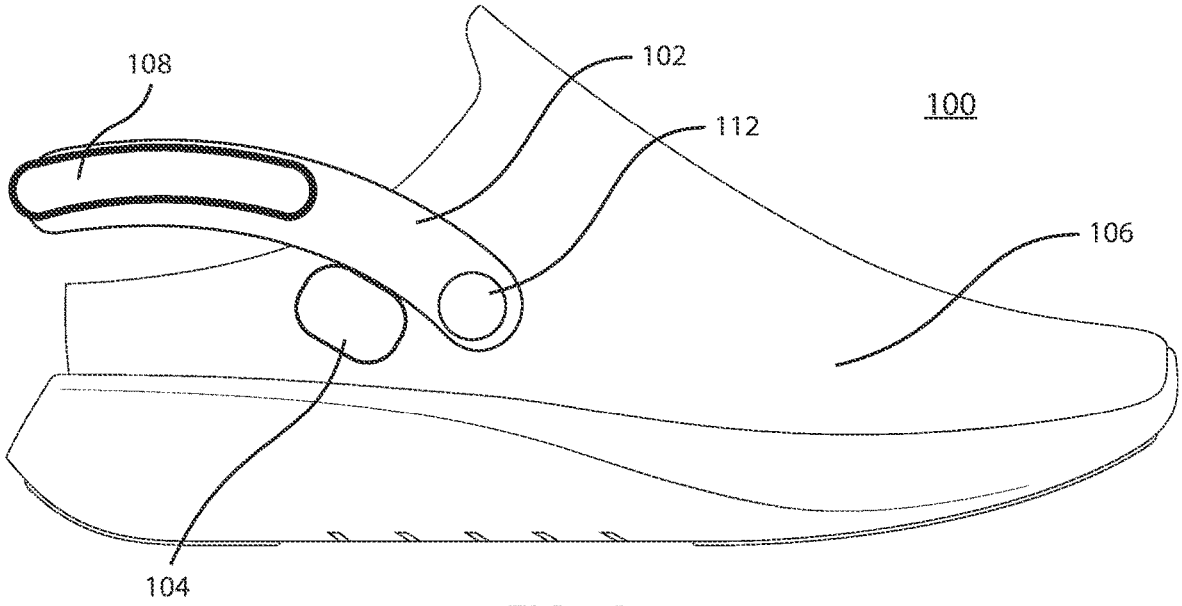

With reference to FIGS. 1A and 1B, in example embodiments a fulcrum 104 is coupled to a lateral side of the upper 106 (i.e., and not coupled to the rotating rear portion 102) and a stress in the rotating rear portion 102 (as described below) results from a force applied against the fulcrum 104 by the rotating rear portion 102.

Figure 2A:
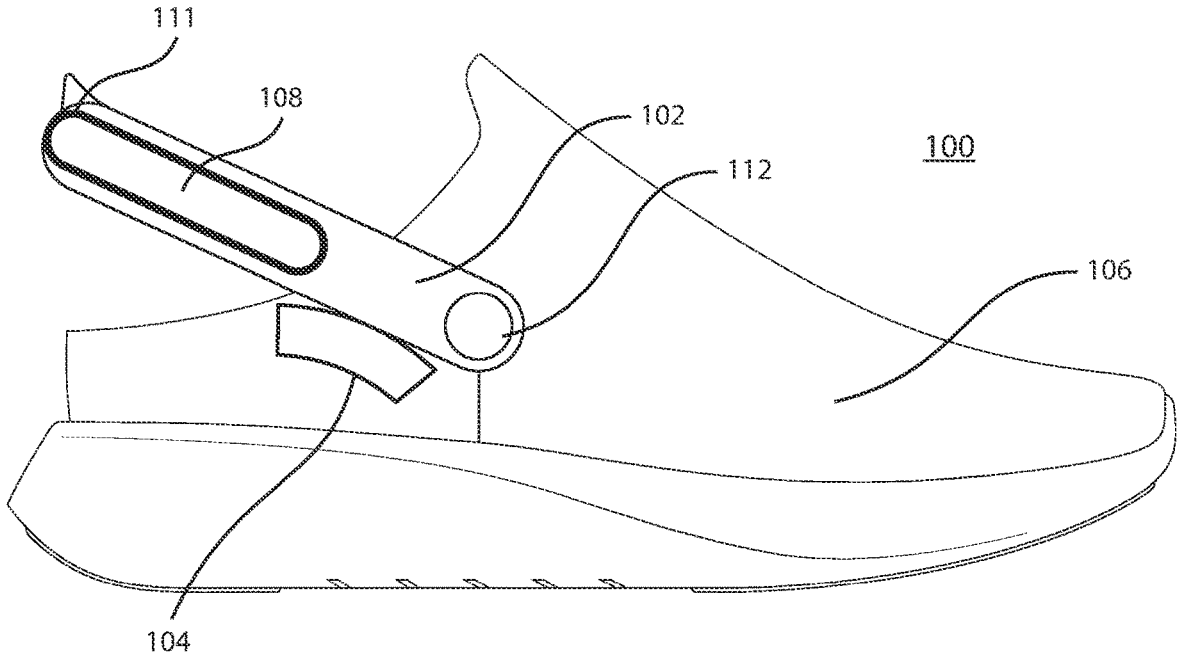
FIGS. 2A and 2B illustrate an example embodiment of a rapid-entry shoe having a fulcrum having a curved or rounded or elongated upper edge, and being coupled to an upper, in uncollapsed and collapsed configurations, respectively.
Figure 2B:
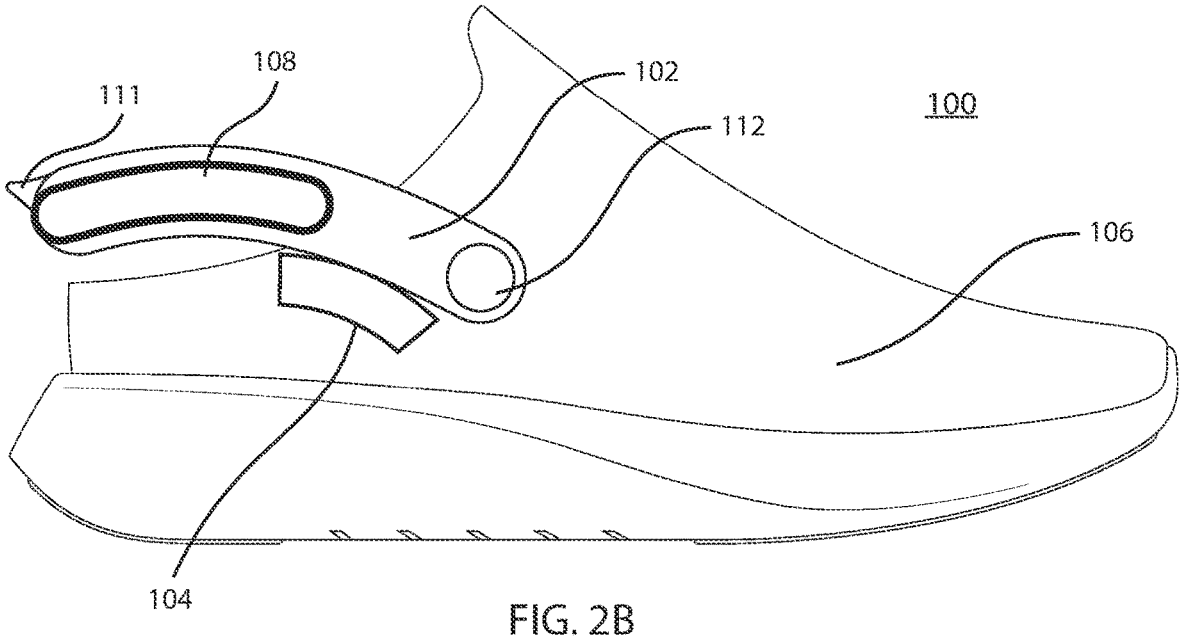

In some embodiments, and with reference to FIGS. 2A and 2B, the fulcrum 104 comprises a curved, rounded and/or elongated upper edge to distribute the force applied by it to the rotating rear portion 102.

In example embodiments, the fulcrum 104 has a thickness greater than a thickness of the rotating rear portion 102 at their respective contact surfaces, so as to prevent the rotating rear portion 102 from rotating beyond the fulcrum 104 (or otherwise prevent lateral motion).

Figure 3A:
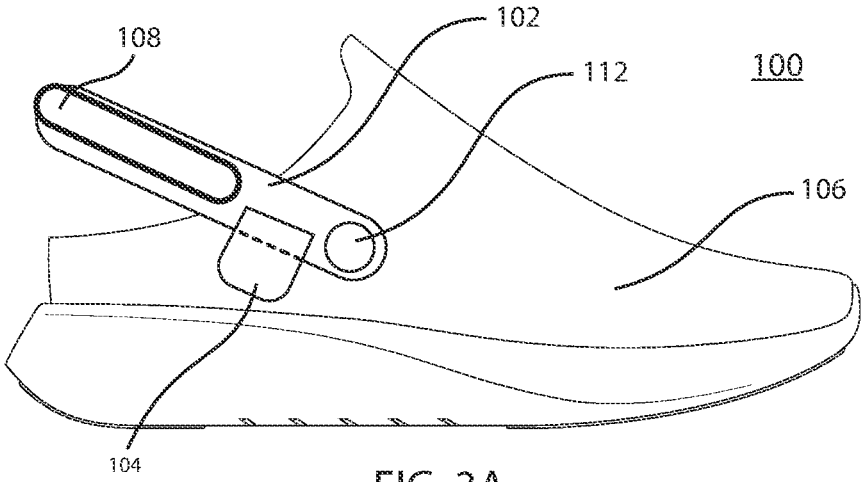
FIGS. 3A and 3B illustrate an example embodiment of a rapid-entry shoe having a fulcrum comprising a slot or lateral flange, and being coupled to an upper, in uncollapsed and collapsed configurations, respectively.
Figure 3B:
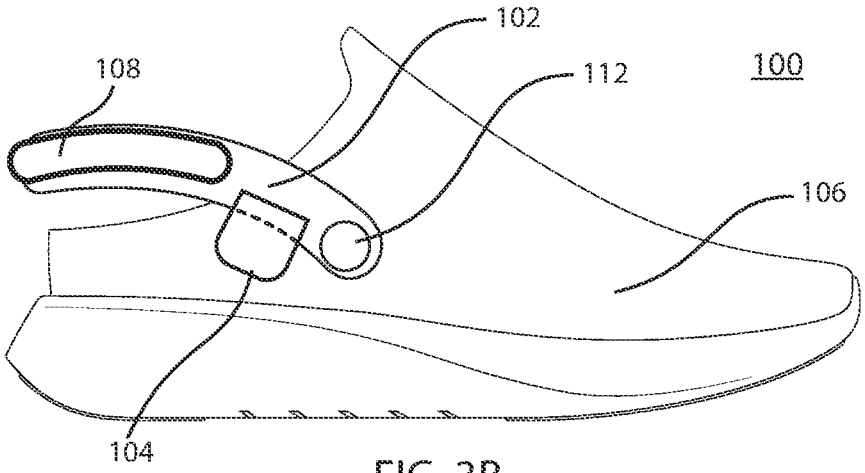
Figure 3C:
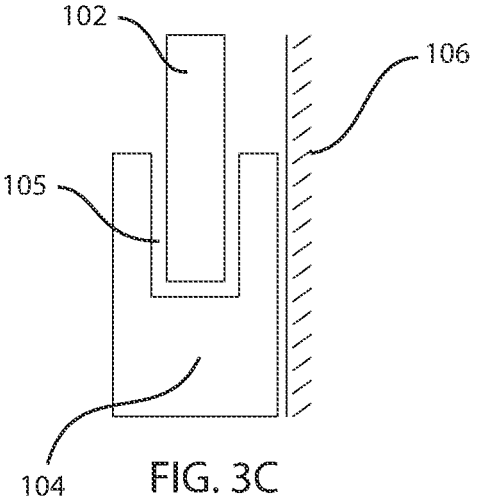
FIGS. 3C and 3D illustrate cross sections of a fulcrum comprising a slot and a fulcrum comprising a lateral flange, respectively.
Figure 3D:
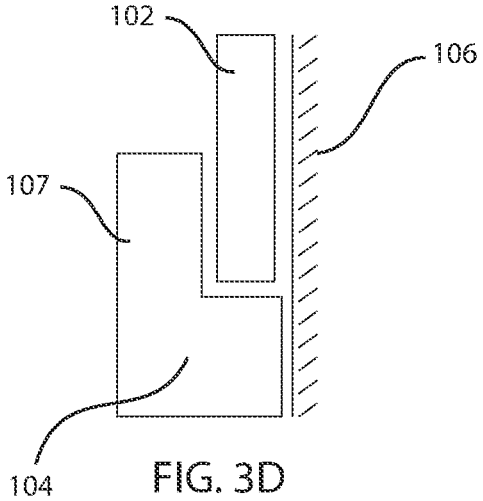

In some embodiments, and with reference to FIGS. 3A and 3B, the fulcrum 104 (e.g., an upper edge of the fulcrum 104) comprises a slot 105 within which to receive (e.g., as illustrated in FIG. 3C) or lateral flange 107 with which to support (e.g., as illustrated in FIG. 3D) the rotating rear portion 102 so as to prevent the rotating rear portion 102 from rotating beyond the fulcrum 104 (or otherwise prevent lateral motion of the rotating rear portion 102). In example embodiments, the depth of the slot 105 is less than the width of the rotating rear portion 102, while in other embodiments, the depth of the slot 105 is greater than such width. In example embodiments, the height of the lateral flange 107 is less than the width of the rotating rear portion 102, while in other embodiments, the height of the lateral flange 107 is greater than such width. In example embodiments, an edge of the slot 105 or lateral flange 107 can be tapered so as to direct movement of an edge of the rotating rear portion 102 therein.

Figure 4A:
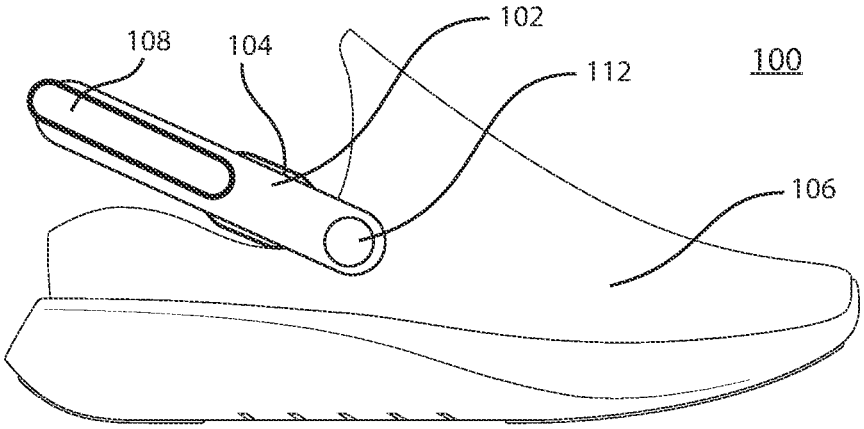
FIGS. 4A and 4B illustrate an example embodiment of a rapid-entry shoe having a fulcrum coupled to a rotating rear portion, in uncollapsed and collapsed configurations, respectively.
Figure 4B:
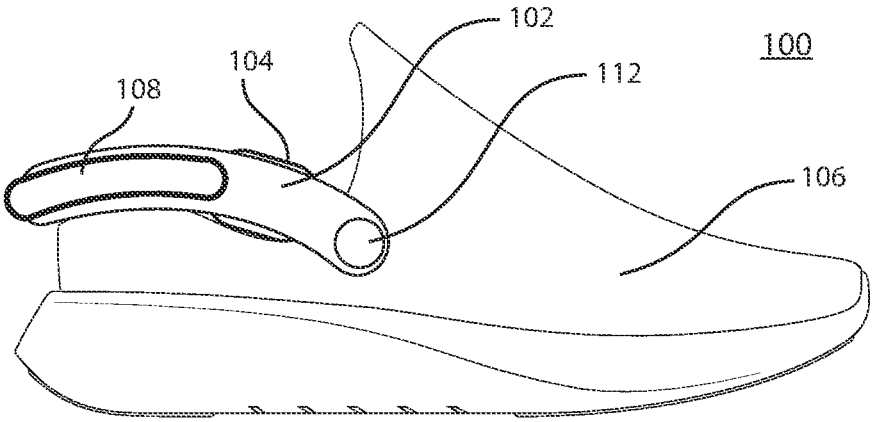
Figure 4C:
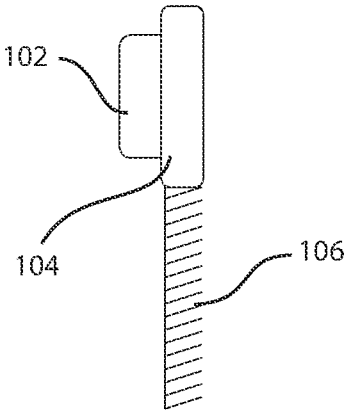
FIG. 4C illustrates a cross section of the embodiment illustrated in FIGS. 4A-4B.

With reference to FIGS. 4A-4C, in example embodiments a fulcrum 104 is coupled to a medial side of the rotating rear portion 102 (i.e., and not coupled to the upper 106) and a stress in the rotating rear portion 102 (as described below) results a force applied against a topline edge of upper 106 by the fulcrum 104 (to which the rotating rear portion 102 is coupled). In such embodiments, fulcrum 104 may have a width greater than a width of the rotating rear portion 102.

Figure 5A:
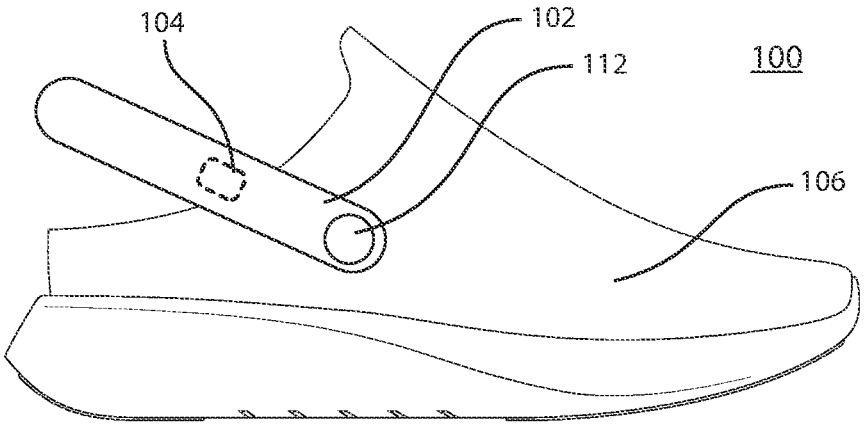
FIGS. 5A and 5B illustrate another example embodiment of a rapid-entry shoe having a fulcrum coupled to a rotating rear portion, in uncollapsed and collapsed configurations, respectively.
Figure 5B:
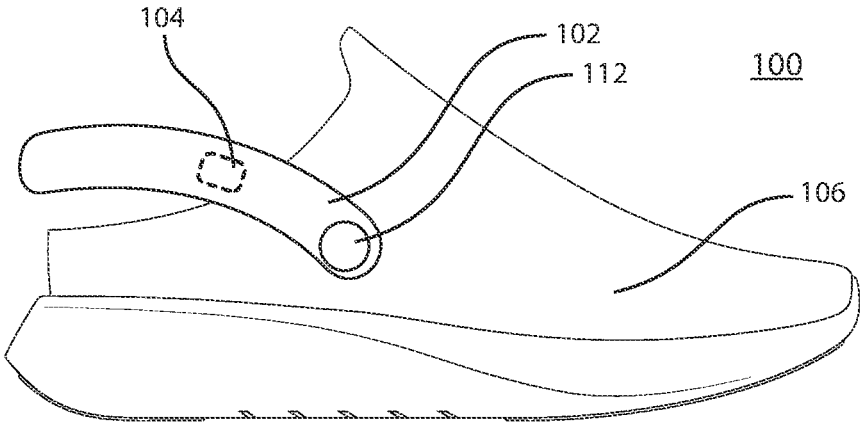
Figure 5C:
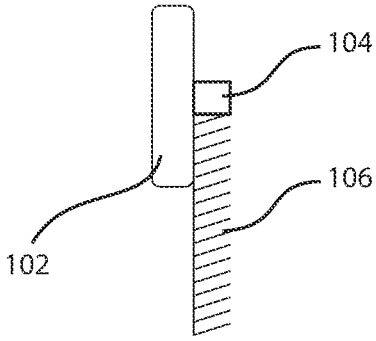
FIG. 5C illustrates a cross section of the embodiment illustrated in FIGS. 5A-5B.

In other embodiments, and with reference to FIG. 5A-5C, fulcrum 104 may have a width smaller than a width of the rotating rear portion 102 and be configured to contact a topline edge of upper 106 or move within a slot cut into a topline edge of upper 106.

Optionally, and in connection with any of the foregoing embodiments, a rapid-entry shoe 100 in accordance with the present disclosure can further comprise a rear stabilizer 108 coupled to the rotating rear portion 102, the rear stabilizer 108 configured to prevent inward deflection of the rotating rear portion 102.

In general, rear stabilizer 108 can be configured to direct a rear portion of an upper to compress downward and/or lean rearward (and prevent a rear portion of an upper from deflecting inward, which would reduce the perimeter of the opening of rapid-entry shoe 100). In this regard, in example embodiments, rear stabilizer 108 is configured to prevent inward deflection of the rotating rear portion when the rapid entry shoe is deformed to the collapsed configuration.

In some embodiments, the rear stabilizer 108 is v-shaped, u-shaped, horse-shoe-shaped (with consistent or inconsistent curvature as it rounds a rear portion of an upper), or otherwise has an elongated shape, and thus extends around a rear portion of an upper. Rear stabilizer 108 can be coupled to an inside or outside surface of rotating rear portion 102, or be embedded within rotating rear portion 102.

In example embodiments, rear stabilizer 108 comprises a mechanical property different from that of an adjacent rotating rear portion 102, the mechanical property being one or more of material, cross-section, thickness, geometry, twisting and density. For instance, rear stabilizer 108 can comprise a reinforced section of rotating rear portion 102. In example embodiments, rear stabilizer 108 is more rigid than adjacent rotating rear portion 102.

Without limiting the foregoing, in some embodiments rear stabilizer 108 can be comprised of a thicker or more dense section of the same material of which rotating rear portion 102 is comprised, but geometrically adjusted to provide stability to rotating rear portion 102.

Optionally, and with momentary reference back to FIGS. 2A and 2B, a rapid-entry shoe 100 in accordance with the present disclosure can further comprise a flare 111 coupled to the rotating rear portion 102, the flare 111 extending rearward and acting as a shoehorn (e.g., to direct a foot into the foot opening during entry).

In example embodiments, the rapid-entry shoe 100 disclosed herein comprises an uncollapsed configuration.

In example embodiments, the rapid-entry shoe 100 disclosed herein comprises a collapsed configuration to facilitate donning and doffing of the rapid-entry shoe 100 (e.g., a topline edge or opening for receiving a user's foot in the collapsed configuration can have a greater circumference than in the uncollapsed configuration). In accordance with example embodiments, in the collapsed configuration, the rotating rear portion is rotated around the axis of rotation toward the sole portion (e.g., by the downward force of a user's foot) and deflected at the fulcrum to create a stress in the rotating rear portion (e.g., a tensile stress adjacent an upper edge of the rotating rear portion and a compressive stress adjacent a lower edge of the rotating rear portion). In accordance with example embodiments, the rapid-entry shoe 100 is biased by the stress toward the uncollapsed configuration.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:
a sole portion;
an upper coupled to the sole portion;
a rotating rear portion coupled to opposing sides of the upper through an axis of rotation;
a fulcrum coupled to the upper and the fulcrum not coupled to the rotating rear portion; and
wherein the rapid-entry shoe has an uncollapsed configuration;
wherein the rapid-entry shoe has a collapsed configuration to facilitate donning and doffing of the rapid-entry shoe;
wherein, in the collapsed configuration, the rotating rear portion is rotated around the axis of rotation toward the sole portion and deflected at the fulcrum to create a stress in the rotating rear portion;
wherein the stress results from contact between the fulcrum and the rotating rear portion; and
wherein the rapid-entry shoe is biased by the stress toward the uncollapsed configuration.

2. The rapid-entry shoe of claim 1, wherein the rotating rear portion is a strap.

3. The rapid-entry shoe of claim 1, wherein the fulcrum comprises one of a slot and a lateral flange to prevent the rotating rear portion from rotating beyond the fulcrum.

4. The rapid-entry shoe of claim 3, wherein the lateral flange comprises an edge that is tapered to direct movement of an edge of the rotating rear portion.

5. The rapid-entry shoe of claim 1, further comprising a u-shaped rear stabilizer coupled to the rotating rear portion, the rear stabilizer configured to prevent inward deflection of the rotating rear portion when the rapid-entry shoe is in the collapsed configuration.

6. The rapid-entry shoe of claim 1, wherein a perimeter of the rotating rear portion is greater than a perimeter of a rear portion of the upper.

7. The rapid-entry shoe of claim 6, wherein the perimeter of the rotating rear portion is greater than a perimeter of a rear portion of the sole portion.

8. The rapid-entry shoe of claim 1, wherein the fulcrum comprises a curved, rounded or elongated upper edge to evenly distribute the stress along a portion of the rotating rear portion.

9. A rapid-entry shoe comprising:

a sole portion;

an upper coupled to the sole portion;

a rotating rear portion coupled at a coupling to opposing sides of the upper through an axis of rotation;

a plurality of fulcrums coupled to opposing sides of the upper and no fulcrum of the plurality of fulcrums coupled to the rotating rear portion; and wherein the rapid-entry shoe has an uncollapsed configuration;

wherein the rapid-entry shoe has a collapsed configuration to facilitate donning and doffing of the rapid-entry shoe;

wherein, in the collapsed configuration, the rotating rear portion is rotated around the axis of rotation toward the sole portion and deflected by at least one fulcrum of the plurality of fulcrums to create a stress in the rotating rear portion;

wherein the stress results from contact between the at least one fulcrum of the plurality of fulcrums and the rotating rear portion; and wherein the rapid-entry shoe is biased by the stress toward the uncollapsed configuration.

10. The rapid-entry shoe of claim 9, wherein the coupling permits rotational relative movement between the rotating rear portion and the upper.

11. The rapid-entry shoe of claim 9, wherein at least one fulcrum of the plurality of fulcrums comprises one of a slot and a lateral flange to prevent the rotating rear portion from rotating beyond the at least one fulcrum of the plurality of fulcrums.

12. The rapid-entry shoe of claim 11, wherein the lateral flange comprises an edge that is tapered to direct movement of an edge of the rotating rear portion.

13. The rapid-entry shoe of claim 9, further comprising a u-shaped rear stabilizer coupled to the rotating rear portion, the rear stabilizer configured to prevent inward deflection of the rotating rear portion when the rapid-entry shoe is in the collapsed configuration.

14. The rapid-entry shoe of claim 9, wherein a perimeter of the rotating rear portion is greater than a perimeter of a rear portion of the upper.

15. The rapid-entry shoe of claim 14, wherein the perimeter of the rotating rear portion is greater than a perimeter of a rear portion of the sole portion.

16. The rapid-entry shoe of claim 9, wherein at least one fulcrum of the plurality of fulcrums comprises a curved, rounded or elongated upper edge to evenly distribute the stress along a portion of the rotating rear portion.

* * * * *